US006129150A

United States Patent [19]

Lima

[11] Patent Number: 6,129,150

[45] Date of Patent: Oct. 10, 2000

[54] METHOD AND EQUIPMENT FOR OFFSHORE OIL PRODUCTION BY INTERMITTENT GAS INJECTION

[75] Inventor: Paulo Cesar Ribeiro Lima, Milton Keynes, United Kingdom

[73] Assignee: Petroleo Brasileiro S.A. - Petrobras, Brazil

[21] Appl. No.: 09/202,321

[22] PCT Filed: May 1, 1997

[86] PCT No.: PCT/GB97/01199

§ 371 Date: May 20, 1999

§ 102(e) Date: May 20, 1999

[87] PCT Pub. No.: WO97/47857

PCT Pub. Date: Dec. 18, 1997

[30] Foreign Application Priority Data

Jun. 12, 1996 [BR] Brazil ..... 9602747

[51] Int. Cl.[7] ..... E21B 43/36

[52] U.S. Cl. ..... 166/357; 166/372

[58] Field of Search ..... 166/357, 372

[56] References Cited

U.S. PATENT DOCUMENTS

| | | | |
|---|---|---|---|
| 3,261,398 | 7/1966 | Haeber | 166/357 |
| 4,506,735 | 3/1985 | Chaudot | 166/357 |
| 4,527,632 | 7/1985 | Chaudot | 166/357 |
| 4,705,114 | 11/1987 | Schroeder et al. | 166/357 |
| 4,967,843 | 11/1990 | Corteville et al. | 166/375 |
| 4,982,794 | 1/1991 | Houot | 166/357 |
| 5,211,242 | 5/1993 | Coleman et al. | 166/372 |
| 5,460,227 | 10/1995 | Sidrim | 166/357 |
| 5,477,924 | 12/1995 | Pollack | 166/357 |
| 5,671,813 | 9/1997 | Lima | 166/372 |
| 5,911,278 | 6/1999 | Reitz | 166/372 |

FOREIGN PATENT DOCUMENTS

| | | |
|---|---|---|
| 331 295 | 9/1989 | European Pat. Off. . |
| 2 222 961 | 3/1990 | United Kingdom . |

*Primary Examiner*—Hoang Dang
*Attorney, Agent, or Firm*—Nixon & Vanderhye PC

[57] ABSTRACT

A subsea primary separating vessel (2) is installed close to the wellhead (1) of an oil producing well to effect primary separation of the liquid and gas phases of the produced fluids. A line (3) connected to the top of the separating vessel allows the separated gases to flow to a collecting vessel (7) located at any gathering station. The liquid phase flows to the gathering center through a flow line (21) which distributes the fluids into a U-shaped pipe length (13), each end of which is connected to a flow line (4 or 5) along which the liquid phase flows to a surge tank (8). When the volume of liquid phase which has settled out within the flow lines begins to exert a back pressure which has a prejudicial effect on well production, high pressure gas can be injected into the flow lines for a specific period of time to promote flow of the liquid phase to the surge tank (8). If it is desired to increase the efficiency of the flow, a mechanical interface driven by the high pressure gas may be used to promote removal of the liquid phase.

10 Claims, 1 Drawing Sheet

METHOD AND EQUIPMENT FOR OFFSHORE OIL PRODUCTION BY INTERMITTENT GAS INJECTION

Figure 1:
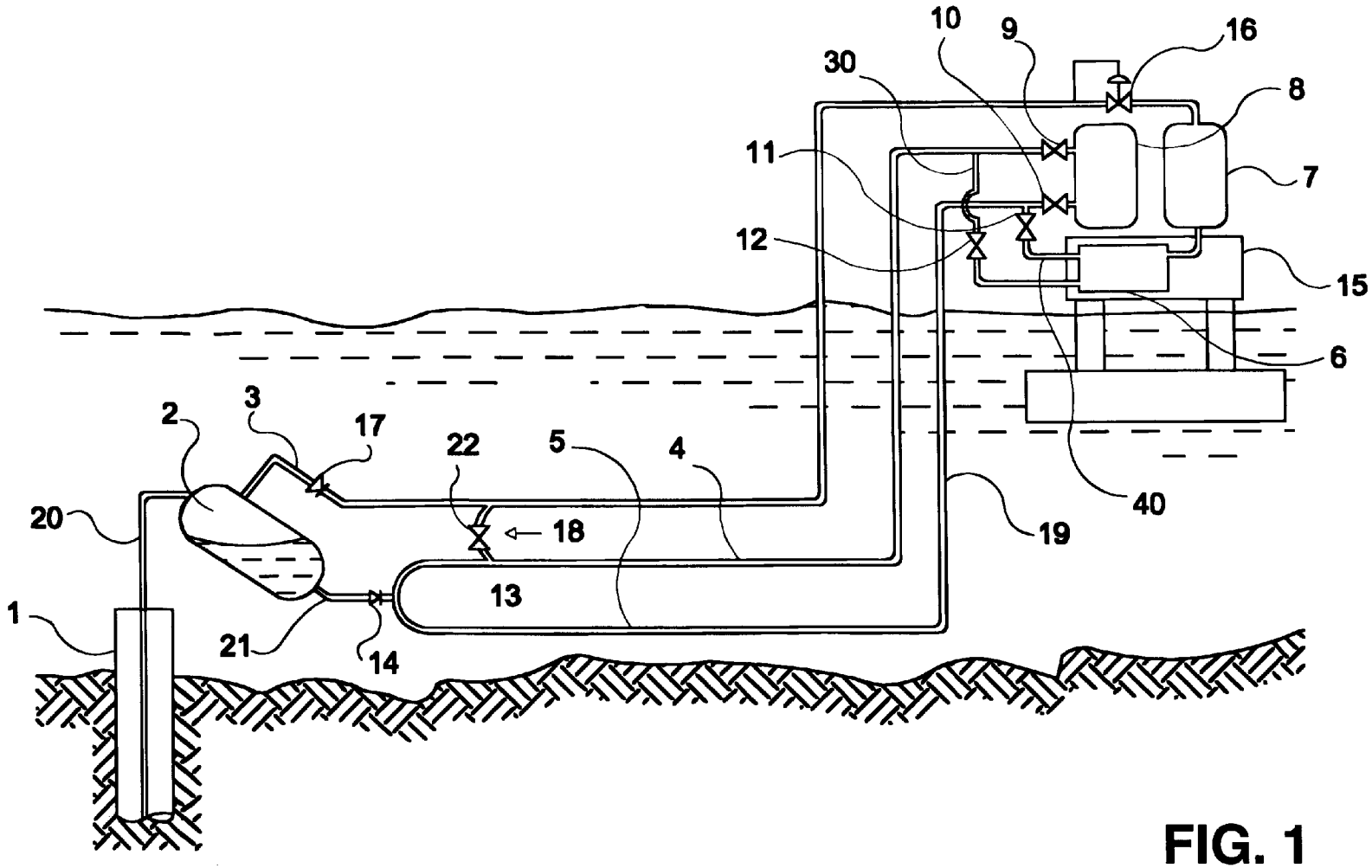

This application is the national phase of international application PCT/GB97/01199 filed May 1, 1997 which designated the U.S.

This invention relates to a method and equipment to encourage the flow, to the surface, of hydrocarbon mixtures containing a high concentration of gas. It may be applied in a single offshore oil well or in an undersea gathering line (manifold) which receives the production from various wells for subsequent delivery.

In the flow of oil, as occurs in undersea production lines, large pressure head losses occur, due mainly to the high flow rates of gas and oil which flow simultaneously and which give rise to high shear stresses in the flow.

In the technique of deep offshore production another factor giving rise to high pressure gradients is the great difference in level between the wellhead and the platform, which frequently makes it necessary to use long vertical pipes, known to those skilled in the art as "risers", to deliver the production flow to the surface.

These factors result in there being high pressures at the wellhead or in the undersea gathering line (manifold), significantly reducing production.

This invention aims to promote primary separation of the liquid and gas phases of the fluids produced by an oil producing well and to encourage flow of these two phases to a gathering centre along separate flow lines.

Accordingly one aspect of the present invention provides equipment for offshore oil production for the intermittent injection of gas, characterized in that it comprises:

a subsea primary separating means which receives the production from an offshore oil well leaving a wellhead via a flow line;

a separated gas flow line which connects the top of the primary separating means to a collecting vessel located at a gathering centre; a flow line which is fitted with a check valve, which connects the lower part of subsea primary separating means to a U-shaped length of pipe which has one of its ends connected to a flow line and its other end connected to a surge tank located at the or a gathering centre;

shut-off valves in the respective flow lines close to the surge tank;

a high pressure gas injection line which connects compressed gas supply system to a said flow line at a point close to the surge tank;

a high pressure gas injection line which similarly connects the gas compressed gas supply system to the other said flow line; and high pressure gas injection lines fitted with respective shut-off valves.

The undersea primary separating means receives the fluids produced by the oil well and brings about a primary separation between the liquid and gas phases.

The gas phase flows to the gathering centre along a line connected to the top of a separating vessel serving as the undersea primary separating means.

The liquid phase flows to the gathering centre along a flow line which distributes the fluids into the U-shaped length of pipe, each end of which is connected to flow lines.

High pressure gas injection lines connect a compressed gas supply system to the flow lines and make it possible to inject high pressure gas into each of these flow lines for a specific period so as to assist removal of the liquid phase accumulating in these lines. The shut-off valves located in the high pressure gas injection lines are used to enable the flow of injected gas.

The check valve fitted in the flow line which distributes fluids to the U-shaped length of pipe prevents the high pressure gas injected into the flow lines from passing into the undersea primary separating means.

If it is desired to increase flow efficiency, a mechanical interface can be used to push the liquid phase deposited in the flow line to the gathering centre. In this case the high pressure gas injection lines must be provided with means to allow a mechanical interface to be inserted into the flow lines. The flow lines must also be provided with means which make it possible to remove the mechanical interfaces, if necessary without interrupting production.

The separated gas flow line may be fitted with a pressure control valve which provides control of the level of the liquid phase of fluid produced which accumulates in the undersea primary separating means.

A second aspect of the invention provides a method for the offshore production of oil with primary gas separation and flow, by high pressure gas injection, characterized in that it comprises the following steps:

a) closing shut-off valves and in high pressure gas injection lines;

b) flowing the fluids produced by the well along a flow line from wellhead to subsea primary separating means where a primary separation between the liquid and gas phases takes place;

c) allowing the liquid phase to collect in the lower part of said subsea primary separating means and also to accumulate in flow lines;

d) when the back pressure exerted by the volume of fluids accumulated in said flow lines begins to rise and prejudices production from the well, closing one of two shut-off valves fitted in the flow lines and then opening for a previously determined period one of the shut-off valves in a high pressure gas injection line connected to the flow line in which the previously closed shut-off valve is located and maintaining the gas flow for a previously determined length of time so as to permit a volume of high pressure gas to pass into the flow line;

e) while thus preventing it from flowing into a surge tank because the shut-off valve in the flow line is closed, passing the volume of gas along the entire length of the flow line, passing it through a U-shaped pipe length, and returning it along the other flow line to a gathering centre while entraining in its travel the entire volume of fluid which was located in the flow lines, and meanwhile using a check valve fitted in the flow line close to the point of its connection with the U-shaped pipe length to prevent the injected high pressure gas from passing into the subsea primary separating means;

f) once the above cycle (a)–(e) is complete, again opening the shut-off valve in the flow line which was previously closed and again allowing the liquid phase to accumulate in the flow line into which the high pressure gas is injected, thus completing performance of the method.

These and other characteristics of this invention will be better understood from the following detailed description which is provided merely by way of example, in association with the accompanying drawing, which forms an integral part of this description, and which is a diagrammatical representation of application of the method and equipment according to this invention, in which two lines are used for production flow.

FIG. 1 shows a diagrammatic representation of an embodiment of the equipment according to this invention in which two flow lines 4 and 5 are used to promote the flow of the liquid phase of the produced fluids from an offshore oil well to a gathering centre, in this case on a platform 15. In this embodiment the fluids are collected in a surge tank 8 located on the platform 15. A shut-off valve 9 is fitted in flow line 4 and a shut-off valve 10 is fitted in flow line 5, both of these valves being located close to the surge tank 8.

Wellhead 1 is connected by flow line 20 to the top of an undersea separating means, shown in the FIGURE as an undersea primary separating vessel 2, whose function is to bring about a primary separation of the liquid and gas phases of the fluids produced by the offshore oil well.

A flow line 21 connects the lower part of this undersea primary separating vessel 2 to a gathering line which in this embodiment is a U-shaped length 13 of pipe which has one of its ends connected to the flow line 4 and its other connected to the flow line 5. This flow line 21 has a check valve 14 fitted close to the point of connection with U-shaped pipe length 13.

To the upper part of the undersea primary separating vessel 2 is connected a flow line 3 for the separated gas and this in turn connects to a collecting vessel 7 which in this embodiment is located on the platform 15. Gas separating out in undersea primary separating vessel 2 should preferably flow along this separated gas flow line 3.

FIG. 1 also shows a pressure control valve 16 fitted in the separated gas flow line 3. This valve is optional, and may be located at any point in the line and is designed to control the flow of separated gas to collecting vessel 7 in accordance with limits defined by the operating conditions.

A U-shaped length 18 of pipe connects one (4) of the flow lines to the separated gas flow line 3. In the embodiment shown in FIG. 1 the flow line 4 is the one selected but it could have been flow line 3 instead. As will be seen below the U-shaped pipe length 18 is optional, and if it is used it is necessary to install a check valve 17 between the undersea primary separating vessel 2 and the U-shaped pipe length 18.

A compressed gas supply system, illustrated in the FIGURE as a vessel 6, supplies gas to two high pressure gas injection lines 30 and 40 which are fitted with shut-off valves 12 and 11 respectively. The high pressure gas injection line 30 is connected to the flow line 4 at a point close to the surge tank 8. The other high pressure gas injection line 40 is similarly connected to the flow line 5.

The method according to this invention will now be described step-by-step:

a) The shut-off valves 12 and 11 in the high pressure gas injection lines 30 and 40 are closed.

b) The production flow from the well flows along the flow line 20 from the wellhead 1 to the subsea primary separating vessel 2 where a primary separation between the liquid and gas phases takes place.

c) The liquid phase collects in the lower part of the subsea primary separating vessel 2 and also accumulates in the flow lines 21, 4, 5; as the liquid phase accumulates in lengths of the flow lines 4 and 5, which are horizontal or which have a small gradient, the back pressure exerted by this volume of fluids on well production is small.

d) When the back pressure begins to rise, and prejudices production from the well, one (9 or 10) of the shut-off valves fitted in the flow lines 4 and 5 is closed, and the shut-off valve 12, 11 in the respective high pressure gas injection line 30 or 40 connected to that flow line in which the now closed stop valve 9 or 10 is located is then opened for a previously determined length of time so as to permit a volume of high pressure gas to pass into the flow line.

e) Being prevented from flowing into the surge tank 8 because the associated shut-off valve 9 or 10 in the respective flow line 4 or 5 is now closed, the volume of injected gas passes along the entire length of the flow line 4, 5 and then passes through the U-shaped pipe length 13 and returns along the other flow line 5, 4 to the gathering centre, entraining in its travel the entire volume of fluid which was located in the two flow lines and the U-shaped pipe length 13; meanwhile the check valve 14 fitted in the flow line 21 close to the point of its connection to the U-shaped pipe length 13 prevents the injected high pressure gas from passing into the subsea primary separating vessel 2.

f) Once the above cycle (a)–(e) is complete, the shut-off valve 9 or 10 in the respective flow line 4 or 5 which was previously closed in step (d) is again opened and the liquid phase again accumulates in the flow line 4 or 5 into which the high pressure gas has just been injected, thus completing performance of the method.

One possible way of increasing the flow efficiency of the liquid phase pushed by the high pressure gas is to use a mechanical interface 19 to prevent direct contact between the high pressure gas and the production fluid (gas and liquid) phases, because this direct contact between two miscible fluids may cause a reduction in the flowing volume.

If such mechanical interfaces are used, means are required to allow passage of the mechanical interface from the high pressure gas injection lines 30, 40 to the flow lines 4, 5, and it is also necessary that the flow lines 3, 4 should have means to receive, and if necessary remove, these interfaces without interrupting production. These means are not described here as they do not form an integral part of the invention and are also well known to those skilled in the art.

If mechanical interfaces are used, the method for using the equipment will be performed in a cyclical fashion, because the mechanical interface will be inserted first into one flow line and then into the other to allow a single mechanical interface to shuttle back and forth in the lines 4, 5. If installations for inserting and receiving mechanical interfaces similar to those described in GB-A-2,297,129 are used there will be no need to remove the mechanical interface from within the system.

When such mechanical interfaces are to be used the shut-off valves 9, 10, and the optional further shut-off valve 22 and pressure control valve 16 may all need to be clear flow valves, i.e. valves which will pass the interface therethrough when the valve is fully open.

It is recommended that a pressure control valve 16 should be fitted in the separated gas flow line 3 to make it possible to control the level of the liquid phase of produced fluid which accumulates in the subsea primary separating vessel 2 as it opens or closes in accordance with previously determined limits according to whether the gas pressure increases or decreases, thus making it possible to maintain the flow of liquid phase in subsea primary separating vessel 2 within desirable limits.

There is always the possibility that the separation of the liquid and gas phases which occurs within primary subsea separating vessel 2 may be incomplete, or that precipitation of the liquid phase may occur when separated gas is being passed along the separated gas flow line 3, as a result of peculiar flow conditions.

In these circumstances it is desirable that this liquid phase should be withdrawn, because it causes serious problems. It is therefore suggested that a U-shaped pipe length 18 with a through-flow shut-off valve 22 should be fitted to connect one of flow lines 4, 5 to separated gas flow line 3 to make it possible to launch into the gas flow line 3 a mechanical interface driven by high pressure gas in order to remove liquid phase from within the separated gas flow line 3.

In the embodiment illustrated in FIG. 1 it has been decided to connect the flow line identified by number 4 to the separated gas line 3. Means must be used which allow passage of the mechanical interface from that flow line 4 to U-shaped pipe length 18. Merely by way of example it is suggested that in this case the device described in Brazilian patent PI9601401-6 by the applicant should be used. Nevertheless, any other type of device which satisfactorily performs the task may be used.

It is important to note that the gas which separates out in the subsea primary separating vessel 2 reaches the surface as a possible raw material for the gas compression process used to remove liquid phase from the flow lines, and this makes the process typically cyclical and easy to control.

It is suggested that in the embodiment illustrated in the FIGURE the gathering centre for the fluids produced, the gas compression system and the separated gas gathering vessel are concentrated at a single point, namely a platform 15. This example is however merely for illustrative purposes, because these installations may be located anywhere else and need not be concentrated at a single point. Thus the location suggested for these installations in this description cannot in any way be regarded as a factor restricting the invention.

What is claimed is:

1. An apparatus for offshore oil production, comprising:

a subsea primary separator receiving a production from an offshore oil well delivered from a wellhead through a flow line;

a separated gas flow line connecting an upper part of said primary separator to a collecting vessel located at a gathering center;

a flow line fitted with a check valve and connecting a lower part of said subsea primary separator to a means for conveying said production from an offshore well to a gathering center; wherein said means for conveying said production of an offshore well comprises a gathering length of pipe with a U-shape having its ends connected to a pair of flow lines, each flow line of said pair of flow lines having its other end connected to a surge tank located at said gathering center, each flow line of said pair of flow lines having shut-off valves located close to a surge tank in said gathering center; and a pair of high pressure gas injection lines, each of said high pressure gas injection lines being connected at one end to a compressed gas supply system and at the other end to a respective flow line of said pair of flow lines at a point close to said surge tank, each of said high pressure gas injection lines being provided with a shut-off valve.

2. The apparatus recited in claim 1, further comprising a pressure control valve being provided in said separated gas flow line to permit control of gas pressure in said line, for allowing indirect control of liquid level in said subsea primary separator.

3. The apparatus recited in claim 1, further comprising:

a further U-shaped length of pipe having a clear-flow shut-off valve and providing a connection between one flow line of said pair of flow lines and said separated gas flow line to provide a passage for a mechanical interface propelled for a volume of high pressure gas from said one flow line to said separated gas flow line, said mechanical interface being intended to remove any liquid phase which may have deposited within said separated gas flow line; and wherein a check valve is installed in said separated gas flow line between a point of connection of said further U-shaped pipe length to said separated gas flowline and said subsea primary separator, said check valve for preventing said removed liquid phase from passing said subsea primary separator.

4. The apparatus recited in claim 3, further comprising a pressure control valve being provided in said separated gas flow line to permit control of gas pressure in said line, for allowing indirect control of liquid level in said subsea primary separator.

5. The apparatus recited in claim 1, further comprising:

a means for allowing the passage of a mechanical interface from each of said high pressure gas injection lines to each of said pair of flow lines, said mechanical interface being propelled by a volume of gas at a high pressure for pushing a production phase existing in each said flow line to said surge tank, said mechanical interface being also intended to prevent a direct contact between said volume of gas and said production phase existing in each said flow line; and a means for receiving and for removing said mechanical interface from each said flow line without interrupting production when said mechanical interface comes back to said gathering center after having pushed said production phase existing in each said flow line.

6. A method for offshore oil production with primary gas separation and flow by intermittent gas injection, comprising the following steps:

flowing fluids produced by an oil well along a flow line from a wellhead to a subsea primary separator where a primary separation between liquid and gas phases takes place;

allowing said liquid phase to collect in a lower part of said subsea primary separator and also to accumulate in a primary flow line and also in a conveying means;

allowing said accumulated liquid phase to be conveyed to a gathering center by means of a pressurized volume of gas being injected into said conveying means;

wherein the method further comprises the following steps:

before flowing said fluids from a wellhead to said subsea primary separator, closing each shut-off valve existing in a pair of high pressure gas injection lines coming from a compressed gas supply system, each said high pressure gas injection line being connected to a respective flow line of a pair of flow lines which comprises said conveying means, each flow line being connected at one end to a surge tank located in a gathering center and at the other end to a U-shaped length of pipe, the latter being connected to said lower part of said subsea primary separation means by means of said primary flow line having a check valve located between said lower part of said subsea primary separation means and the connection of said primary flow line to said U-shaped length of pipe;

opening shut-off valves in each flow line of said pair of flow lines, said shut-off valves being located near said surge tank;

when a back pressure exerted by a volume of fluids accumulated in said flow lines begins to rise and prejudices production from said well, closing one of said two shut-off valves fitted in one of said pair of flow lines, and then opening for a previously determined period of time one of said shut-off valves in a high pressure gas injection line connected to said one flow line in which said previously closed shut-off valve is located so as to provoke a high pressure gas flow into said one flow;

maintaining said gas flow for a previously determined period of time so as to permit a high pressure volume of gas to pass into said one flow line;

while thus preventing it from flowing into said surge tank because said shutoff valve in said one flow line is closed, passing said volume of high pressure gas along the entire length of said one flow line, passing it through said U-shaped pipe length, and returning it along said other flow line to said surge tank in said gathering center while entraining in its travel the entire volume of fluid which was located in said flow lines;

meanwhile using said check valve fitted in said primary flow line coming from said subsea primary separator close to a point of its connection with said U-shaped pipe length to prevent said injected high pressure gas from passing into said subsea primary separator;

once the above steps are complete, again opening said shut-off valve in said one flow line which was previously closed and again allowing a liquid phase to accumulate in said flow line into which said high pressure of gas has just been injected.

7. A method as recited in claim 6, wherein the step in which liquid phase accumulates in lengths of said flow lines which are horizontal or which have a small gradient, whereby a back pressure exerted by this volume of fluids on well production is small.

8. A method as recited in claim 6, wherein a mechanical interface is released into one flow line of said pair of flow lines and is driven by said high pressure gas to cause a fluid phase existing in said pair of flow lines to flow to said gathering center.

9. A method as recited in claim 8, wherein the step in which liquid phase accumulates in lengths of said flow lines which are horizontal or which have a small gradient, whereby a back pressure exerted by this volume of fluids on well production is small.

10. A method as recited in claim 6, wherein a separated gas flow line is connected to said upper part of said primary separator and to a collecting vessel located at the gathering center and wherein the method further includes the following steps:

when a precipitation of liquid phase occurs in said separated gas flow line, as a result of peculiar flow conditions, opening of a clear flow shut off valve existing in a second U-shaped pipe length connecting said separated gas flow line to one flow line of said pair of flow lines so as to allow a mechanical interface driven by a high pressure volume of gas to pass from said one flow line to said separated gas flow line for removing said liquid phase from said separated gas flow line; and closing off said clear flow shut-off valve as the entire liquid phase has been removed from said separated gas flow.

* * * * *